United States Patent [19]

Steinberger et al.

[11] 4,351,736

[45] Sep. 28, 1982

[54] PILE-STABILIZING SILICON-CONTAINING TEXTILE AGENTS

[75] Inventors: Helmut Steinberger, Leverkusen; Hans-Heinrich Moretto, Cologne; Wilfried Kortmann, Hagen; Josef Pfeiffer, Leverkusen, all of Fed. Rep. of Germany

[73] Assignee: Bayer Aktiengesellschaft, Leverkusen, Fed. Rep. of Germany

[21] Appl. No.: 227,444

[22] Filed: Jan. 22, 1981

[30] Foreign Application Priority Data

Feb. 9, 1980 [DE] Fed. Rep. of Germany ..... 3004824

[51] Int. Cl.[3] ..... D06M 15/00; C08L 83/06

[52] U.S. Cl. ..... 252/8.6; 524/588; 427/387; 528/18

[58] Field of Search ..... 252/8.6; 260/29.2 M; 528/18; 427/387; 524/588

[56] References Cited

U.S. PATENT DOCUMENTS

| | | | |
|---|---|---|---|
| 3,431,142 | 3/1969 | Schwarz | 427/387 |
| 3,642,681 | 2/1972 | Hermes | 427/387 |
| 3,898,090 | 8/1975 | Clark | 260/29.2 M |
| 3,917,893 | 11/1975 | Marshall et al. | 252/8.6 |
| 3,944,702 | 3/1976 | Clark | 427/387 |
| 3,959,566 | 3/1976 | Pangonis | 427/387 |

FOREIGN PATENT DOCUMENTS

| | | | |
|---|---|---|---|
| 794874 | 9/1968 | Canada | 260/29.2 M |
| 2510872 | 9/1976 | Fed. Rep. of Germany | 252/8.6 |
| 2036053 | 6/1980 | United Kingdom | 427/387 |

OTHER PUBLICATIONS

Hackh's Chemical Dictionary, McGraw Hill, N.Y., 1979, p. 610.

*Primary Examiner*—Maria Parrish Tungol

*Attorney, Agent, or Firm*—Sprung, Horn, Kramer & Woods

[57] ABSTRACT

A textile pile-stabilizing impregnating agent comprising a colloidal suspension of silicic acid having $SiO_2$ units and organosilsesquioxanes having units of the formula $RSiO_{3/2}$ wherein R is an alkyl or aryl radical with up to 7 carbon atoms. It is produced by adding a silane of the formula $RSi(OR')_3$, together with a silane of the formula $Si(OR')_4$, wherein R is an alkyl or aryl radical with up to 7 carbon atoms, and R' is a hydrogen atom or an alkyl radical with 1 to 4 carbon atoms, to a mixture of water and a surface-active agent containing a buffer, the amount of silanes added being about 5 to 22% of the total weight of the addition plus mixture.

9 Claims, No Drawings

PILE-STABILIZING SILICON-CONTAINING TEXTILE AGENTS

The present invention relates to a pile-stabilizing impregnating agent for textiles and a process for its preparation.

The consumer expects modern textile materials which are used, for example, as furniture upholstery materials or as textile floor coverings to have favorable properties with regard to their mechanical strength, that is to say their static and dynamic strength.

A particular problem of articles made of pile materials, that is to say textiles which have a particular structure of the surface as a result of the presence of loops or cut loops (velour) is the retention of this surface structure during their period of use. It is a widely known fact that, for example, carpets made of pile goods already show signs of damage after a relatively short period of use as a result of being walked on, of heavy objects, such as, for example, pieces of furniture, standing on them or of wheel-chairs being moved across them, this damage manifesting itself by a change in the nature of the surface.

Carpets subjected to such wear have pressure marks, grooves and pile which does not lie evenly (so-called tracks).

Furniture upholstery materials suffer similar changes in the nature of their surface, preferentially at the most readily accessible and most heavily used points. The result is an uneven appearance of the textile surface.

Processes for the treatment of fiber materials such as filaments, fibers, woven fabrics and carpet to render them anti-slip and repellent to dry dirt have already been described elsewhere (for example DE-OS (German Published Specification) No. 1,594,985). Colloidal suspensions of silsequioxanes which consist of units of $RSiO_{3/2}$ and have a particle size of 10 to 1,000 Angstroms are used in this process.

However, the silsequioxane suspensions described in the above Specification are relatively unstable and are in no way suitable for providing materials with a pile-stabilizing finish.

It was thus the object of the present invention to provide an agent which is to be used for providing textiles of man-made fiber materials or natural fiber materials and mixtures thereof with a pile-stabilising finish and which is effective and permanent and is not damaged by cleaning.

According to the invention, this object is achieved by using aqueous methylsilsequioxane dispersions in combination with colloidal silicic acid for providing the textiles with the finish.

The present invention thus relates to a pile-stabilizing impregnating agent for textiles which contains colloidal suspensions of organosilsesquioxanes and of silicic acid with $SiO_2$ units.

The invention furthermore relates to a process for the preparation of such stable, aqueous methylsilsequioxane/silicic acid dispersions. The process is characterized in that silanes of the general formula $R—Si(OR')_3$, together with silanes $Si(OR')_4$, wherein R denotes a substituted or unsubstituted hydrocarbon radical with 1 to 7 carbon atoms, the substituents of which can be halogen atoms and amino, mercapto and epoxy groups, up to about 95% of the radicals R being methyl, and R' denotes an alkyl radical with 1 to 4 carbon atoms, are added to a mixture of water, a buffer substance, a surface-active agent and, if appropriate, an organic solvent, while agitating the mixture and under acid or basic conditions.

It is necessary to add the quantity of silane uniformly and slowly in order to achieve a very narrow particle size distribution and a low average particle size of about 200 to 500 Angstroms. The exact amount of silane which can be added depends on the substituent R and on whether an anionic or cationic surface-active agent is used.

Copolymers of the silsequioxanes in which the units can be present in block form or in random distribution are formed by the simultaneous hydrolysis of the silanes. The preferred amount of silane of the general formula $Si(OR')_4$ added is about 2 to 50 percent, relative to the total weight of the silanes employed, preferably about 3 to 20 percent.

The agent according to the invention has approximately the following composition: 0.002 to 7.5% of surface-active agent, 0.05 to 4% of buffer substance, 5 to 22% of silane mixture and 95 to 71% of water, the mixture containing about 2 to 9% by weight of silsequioxanes and about 0.1–0.4% by weight of $SiO_2$ units.

The surface-active agents mentioned have the function of stabilizing the resulting particles of the colloidal suspensions.

The following silanes are preferably employed: methyltrimethoxysilane, methyltriethoxysilane, methyltriisopropoxysilane, ethyltrimetoxysilane, ethyltriethoxysilane, propyltrimethoxysilane, isobutyltrimethoxysilane, isobutyltriethoxysilane, 2-ethylbutyltriethoxysilane, tetraethoxysilane and 2-ethylbutoxytriethoxysilane.

Possible anionic surface-active agents are aliphatic and/or aromatic sulphonic acids, for example decyl-, dodecyl-, cetyl-, stearyl-, myristyl- or oleyl-sulphonic acids, or alkali metal salts thereof. If cationic surface-active agents are used, it is advantageous to use halides, and especially chlorides and bromides. Other surface-active agents, including those of a non-ionic and amphoteric nature, can be used together with the abovementioned agents as long as neither their nature nor their amount adversely influence the stability of the colloidal suspension.

The surface-active agents are employed in an amount of 0.01 to about 15% relative to the amount of silane employed.

The process for the preparation of the colloidal suspensions according to the invention can be carried out at temperatures between room temperature and about 80° C.; the temperature range between 50° and 70° C. is particularly preferred.

For the claimed intended use, it is particularly important to add a buffer which controls the pH value.

The buffer substances, such as, for example, (sodium tetraborate, ammonium bicarbonate, sodium bicarbonate and potassium bicarbonate) are employed in amounts of about 0.05 to 4% by weight, relative to the total mixture.

Since it is known that the behaviour of alkoxysilanes under hydrolysis conditions and the condensation of silanol groups depend on the pH value, the control, according to the invention, of both operations by buffering substances appears to provide particularly favourable preconditions for the preparation of pile-stabilizing compositions.

The finish provided is particularly effective on ball pile and nap goods of man-made fiber materials on an organic and inorganic basis, and on natural fiber materials.

The finishing products can be applied, by treatment in a liquor, padding or spraying on, either before, during or after the dyeing of the textile or other subsequent processing steps, or later, after processing to an upholstery textile, cushion-covering textile or floor covering textile has been carried out.

Another method of applying the colloidal dispersions to the fiber material is to use them together with a cleaning agent, especially if the textile to be treated has been soiled by use or preceding processing steps. Goods which have not hitherto been provided with the finish by the manufacturer are preferably provided with the finish by spraying the formulation onto the goods after they have been subjected to wet cleaning.

The following examples are intended to illustrate the invention in more detail, without thereby limiting them.

EXAMPLE 1

1.7 g of sodium bicarbonate and 8 g of a cationic surface-active agent (quaternary alkyl/aryl-ammonium chloride) are dissolved in 1,700 g of distilled water at room temperature and the solution is warmed to 70° C. When this temperature is reached, 300 g of methyltriethoxysilane and 12 g of tetraethoxysilane are added in the course of 4 hours, the temperature of the reaction mixture being kept at 70° C. When the addition has ended, the sol formed is stirred at 70° C. for 3 hours and then cooled to room temperature.

The resulting product is a readily mobile, slightly opaque liquid.

EXAMPLE 2

430 kg of water, 2.1 kg of sodium tetraborate and 0.4 kg of an anionic surface-active agent (Na dodecylsulphonate) are initially introduced into a kettle with a capacity of 500 liters and are warmed to 60° C. while stirring. 70 kg of methyltriethoxysilane and 8 kg of tetraethoxysilane are then metered in over a period of 5 hours, the reaction temperature being kept at 60° C. When the metering has ended, the mixture is subsequently stirred at the above temperature for 3 hours and is then cooled to room temperature. After subsequent filtration over a hair sieve with a clear mesh width of 0.04 mm, the sol is ready to use.

EXAMPLE 3

After dyeing and before drying, tufted goods with a cut pile (100% polyamide) and a pile weight of 350 g/m$^2$ were provided with a finish of 3%, relative to the pile weight, of the formulation, according to the invention, of Example 2 by spraying the formulation on with the aid of a one-material spraying unit, and the tufted goods were then dried on a stenter at 120° C. for 5 minutes. The goods were then cut uniformly and the underside was coated with a commercially available flat latex foam.

Samples of this material were taken according to the DIN instructions (sample B).

Samples of the goods which had not been treated with the formulation according to the invention were also taken (sample A).

| | Sample A | Sample B |
|---|---|---|
| Pile thickness (before loading) | 3.7 mm | 3.9 mm |
| Static load test DIN 54 316 | | |

-continued

| | Sample A | Sample B |
|---|---|---|
| Impression depth (%), relative to the pile thickness | 20.4 | 15.9 |
| Change in upper side Drum test DIN 54 323 | 3.0 | 3.3 |

(Evaluation scale: 1 = very good, 5 = none)

EXAMPLE 4

Tufted goods with cut pile (100% polyamide) and with a pile weight of 1,200 g/m$^2$ were treated, after dyeing and before drying, with 3%, relative to the pile weight, of the formulation, according to the invention, of Example 1 by the exhaustion process on a winch vat, after dyeing, in the last rinsing bath at 30° C. for 15 minutes. Subsequent drying was carried out on a stenter at 150° C. for 5 minutes. The goods were then cut uniformly and the underside was coated with a commercially available flat latex foam.

Samples of this material were taken according to the DIN instructions (sample B). Samples of the goods which had not been treated with the formulation according to the invention were also taken (sample A).

| | Sample A | Sample B |
|---|---|---|
| Pile thickness | 10.57 mm | 11.53 mm |
| Static load test DIN 54 316 | | |
| Penetration stage, relative to the pile thickness | 16.37% | 10.00% |

EXAMPLE 5

Tufted goods with cut pile (100% wool) and with a pile weight of 850 g were provided, as yarn, with a finish of 4% of the formulation according to the invention by the exhaustion process, after dyeing, in the last rinsing bath (15'/30° C.). Drying was carried out at 120° C. The yarn was then tufted, cut and coated.

SAMPLING

50×30 cm pieces were taken and subjected to a treading test by laying two treated and two untreated samples in a passenger elevator compartment in a checkerboardlike pattern. In the compartment, the material is subjected to a more intensive surface wear by the turning movements of the people using the lift than in the case of treading by walking. The number of treadings is counted electronically. After in each case 10,000 treadings, the positions of the samples in the pattern are changed in circular fashion, in order to ensure uniform wear. After 30,000 treadings, the samples are removed and evaluated visually by 6 different judges. The change in the surface of the untreated samples (A) in comparison with the treated samples (B) is evaluated (Scale: 1=very pronounced change, 5=no change).

| Material | | Sample A | Sample B |
|---|---|---|---|
| 1. Wool | (pile weight 850 g/m$^2$) | 2 | 4 |
| 2. CO | (pile weight 450 g/m$^2$) | 3 | 4 |
| 3. PP | (pile weight 600 g/m$^2$) | 1 | 3 |
| 4. PAC | (pile weight 700 g/m$^2$) | 2 | 4 |
| 5. PES | (pile weight 650 g/m$^2$) | 3 | 4 |
| 6. PA | (pile weight 600 g/m$^2$) | 2 | 4 |

| Finish | Application method | Drying |
|---|---|---|
| 1. Yarn | Exhaustion process, after | |

-continued

| | | |
|---|---|---|
| | dyeing | -/120° C. |
| 2. Piece goods | Spraying process, after dyeing | 5'/150° C. |
| 3. Flock | Spraying process, spun-dyed material | -/- |
| 4. Piece goods | Spraying process, after dyeing | 5'/150° C. |
| 5. Piece goods | Spraying process, after dyeing | 5'/150° C. |
| 6. Piece goods | Spraying process, after dyeing | 5'/150° C. |

EXAMPLE 6

Furniture upholstery fabrics consisting of CO undersides and PAC pile material (total weight: 500 g/m$^2$) were provided with a finish of the formulation, according to the invention, of Example 2 as follows:

A 30 g/l during continuous dyeing

B 30 g/l after dyeing and washing, before drying, by the padding process

C not provided with a finish

SAMPLING

30×30 cm samples were taken and laid out on a laboratory table covered with VA steel. The samples were subjected to a load comprising a steel weight with a contact area coated with polytetrafluoroethylene. (Contact pressure: 78.6 g/cm$^2$; load period: 24 hours).

EVALUATION

The recovery after removal of the load is evaluated visually, in comparison with goods which have not been subjected to load:

| Sample (A) | immediately (B) | after 1 hour (C) | after 3 hours |
|---|---|---|---|
| A | 1 | 2 | 3 |
| B | 1 | 3 | 4 |
| C | 1 | 1 | 2 |

(Scale: 1 = very pronounced change; 5 = no change).

EXAMPLE 7

PA tufted velour goods (pile weight: 450 g/m$^2$) were treated, after dyeing and before drying, by the spraying process: (a) with 3% of the formulation, according to the invention, of Example 2, (b) with 3% of a comparison formulation according to DOS (German Published Specification) No. 1,594,985 and (c) no treatment.

The goods were then dried at 150° C. for 5 minutes and further treated as described in Example 3. Subsequent evaluation was carried out as described in Example 6:

| Sample a | Sample b | Sample c |
|---|---|---|
| 3 | 1 | 1 |

(Scale: 1 = very pronounced change; 5 = no change).

EXAMPLE 8

Laboratory soiling test in accordance with the method of DIN 54 324 (chair caster test).

PA tufted velour goods (pile weight: 450 g/m$^2$) were treated, after dyeing and before drying, by the spraying process: (a) with 3% of the formulation, according to the invention, of Example 2, (b) with 3% of a comparison formulation according to DOS (German Published Specification) No. 1,594,985 and (c) no treatment.

The goods were then dried at 150° C. for 5 minutes and cut uniformly and coated on the underside with a commercially available flat latex foam.

Samples which were in each case the same were taken from this material in accordance with the DIN instructions.

The samples are first soiled with in each case 10 g of an artificial soiling agent of the following composition: 1,932 g of chamotte, 40 g of iron oxide black, 20 g of iron oxide yellow, 8 g of carbon black and 1,000 g of water.

The samples are subjected to load by the chair caster test, which is described in detail in DIN instructions 54 324 under a caster load of 60 kg in total and with the direction of rotation of the casters being changed after every 50 revolutions.

The samples were evaluated as described in Example 6.

| Sample | Evaluation of the surface | Soiling |
|---|---|---|
| (a) | 3 | 4 |
| (b) | 1 | 2 |
| (c) | 1 | 1 |

(Scale: 1 = very pronounced change; 5 = no change).

It will be understood that the specification and examples are illustrative but not limitative of the present invention and that other embodiments within the spirit and scope of the invention will suggest themselves to those skilled in the art.

What is claimed is:

1. A textile pile-stabilizing impregnating agent comprising a colloidal suspension of a silicic acid and organosilsequioxanes having units of the formula $RSiO_{3/2}$ wherein R is an alkyl or aryl radical with up to 7 carbon atoms.

2. An impregnating agent according to claim 1, containing about 2 to 9% by weight of silsesquioxanes and about 0.1 to 0.4% by weight of $SiO_2$ units, relative to the total impregnating agent.

3. An impregnating agent according to claim 1, wherein the silsesquioxanes comprise methylsilsesquioxanes.

4. An impregnating agent according to claim 1, containing about 0.05 to 4% by weight of a buffer.

5. An impregnating agent according to claim 2, wherein the silsesquioxanes comprise methylsilsesquioxanes, the agent containing about 0.05 to 4% by weight of a buffer.

6. A process for the preparation of a colloidal suspension of silsesquioxanes and silicic acid according to claim 1, comprising adding a silane of the formula $RSi(OR')_3$, together with a silane of the formula $Si(OR')_4$, wherein R is an alkyl or aryl radical with up to 7 carbon atoms, and R' is a hydrogen atom or an alkyl radical with 1 to 4 carbon atoms, to a mixture of water and a surface-active agent containing a buffer, the amount of silanes added being about 5 to 22% of the total weight of the addition plus mixture.

7. A process according to claim 6, wherein the silane of the formula $Si(OR')_4$ comprises about 2 to 50% of the total weight of silanes added.

8. A textile material carrying a finish according to claim 1.

9. A textile pile material carrying a finish according to claim 5.

* * * * *